US010583682B2

(12) United States Patent
Dietemann

(10) Patent No.: US 10,583,682 B2
(45) Date of Patent: Mar. 10, 2020

(54) SECURITY STRUCTURE

(71) Applicant: ARJOWIGGINS SECURITY, Boulogne Billancourt (FR)

(72) Inventor: Philippe Dietemann, Saint-martin-d'heres (FR)

(73) Assignee: OBERTHUR FIDUCIAIRE SAS, Paris (FR)

( * ) Notice: Subject to any disclaimer, the term of this patent is extended or adjusted under 35 U.S.C. 154(b) by 673 days.

(21) Appl. No.: 14/415,011

(22) PCT Filed: Jul. 12, 2013

(86) PCT No.: PCT/IB2013/055765

§ 371 (c)(1),
(2) Date: Jan. 15, 2015

(87) PCT Pub. No.: WO2014/013410

PCT Pub. Date: Jan. 23, 2014

(65) Prior Publication Data

US 2015/0174944 A1 Jun. 25, 2015

(30) Foreign Application Priority Data

Jul. 16, 2012 (FR) ..... 12 56869

(51) Int. Cl.
*B42D 25/373* (2014.01)
*B42D 25/328* (2014.01)
(Continued)

(52) U.S. Cl.
CPC ..... *B42D 25/373* (2014.10); *B42D 25/328* (2014.10); *B42D 25/405* (2014.10);
(Continued)

(58) Field of Classification Search
CPC .. B42D 25/373; B42D 25/328; B42D 25/445; B42D 25/405; B42D 25/00; B42D 25/29;
(Continued)

(56) References Cited

U.S. PATENT DOCUMENTS 5,248,544 A * 9/1993 Kaule ..... B41F 19/062 428/195.1
5,901,484 A 5/1999 Seder
(Continued)

FOREIGN PATENT DOCUMENTS

CA 2 471 379 A1 7/2003
CN 101019155 A 8/2007
(Continued)

OTHER PUBLICATIONS

French Preliminary Search Report for French Application No. FR 12 56869 dated May 22, 2013.
(Continued)

*Primary Examiner* — Justin V Lewis
(74) *Attorney, Agent, or Firm* — Jones Robb, PLLC

(57) ABSTRACT

The present disclosure relates to a security structure including a non-opaque, preferably transparent, substrate. The substrate supports metal elements forming a revealing pattern. The metal is thin enough for the metal to be non-opaque. A lacquer is placed at least partially, preferably exactly, on top of the metal elements. The lacquer may be in contact with the metal elements.

25 Claims, 3 Drawing Sheets

(51) Int. Cl.
*B42D 25/405* (2014.01)
*B42D 25/445* (2014.01)

(52) U.S. Cl.
CPC ..... *B42D 25/445* (2014.10); *Y10T 428/24851* (2015.01); *Y10T 428/24868* (2015.01); *Y10T 428/24917* (2015.01)

(58) Field of Classification Search
CPC ..... B42D 2033/20; B42D 2035/16; B42D 2035/36; B42D 2035/50; B42D 2033/04; B42D 2033/08; B42D 2033/10; B42D 2033/06; G07D 7/207; Y10T 428/24851; Y10T 428/24868; Y10T 428/24917
USPC ..... 283/72, 74, 83, 94, 98, 901
See application file for complete search history.

(56) References Cited

U.S. PATENT DOCUMENTS

| | | | | |
|---|---|---|---|---|
| 6,286,873 | B1 | 9/2001 | Seder | |
| 7,762,591 | B2 | 7/2010 | Schilling et al. | |
| 2008/0062485 | A1 | 3/2008 | Menz et al. | |
| 2008/0067801 | A1 | 3/2008 | Schilling et al. | |
| 2009/0186205 | A1 | 7/2009 | Doublet et al. | |
| 2012/0001411 | A1 | 1/2012 | Rosset | |
| 2012/0146323 | A1* | 6/2012 | Schilling | G02B 3/0056 283/85 |
| 2013/0163818 | A1* | 6/2013 | Rosset | G07D 7/128 382/103 |

FOREIGN PATENT DOCUMENTS

| | | | | |
|---|---|---|---|---|
| CN | 101223316 | A | 7/2008 | |
| CN | 101678664 | A | 3/2010 | |
| CN | 101678699 | A | 3/2010 | |
| CN | 102083632 | A | 6/2011 | |
| DE | 10 2006 061 905 | A1 | 7/2008 | |
| EP | 0 229 645 | A1 | 7/1987 | |
| EP | 1 291 463 | A1 | 3/2003 | |
| EP | 1 903 144 | A1 | 3/2008 | |
| GB | 1 552 853 | A | 9/1979 | |
| JP | 2009-102760 | A | 5/2009 | |
| WO | 99/13157 | A1 | 3/1999 | |
| WO | 02/17242 | A1 | 2/2002 | |
| WO | 02/31214 | A1 | 4/2002 | |
| WO | 2004/096482 | A1 | 11/2004 | |
| WO | 2006/029744 | A1 | 3/2006 | |
| WO | 2006029744 | A1 | 3/2006 | |
| WO | 2008/006983 | A1 | 1/2008 | |
| WO | 2010/073225 | A2 | 7/2010 | |
| WO | WO-2011161636 | A1 * | 12/2011 | G07D 7/128 |

OTHER PUBLICATIONS

International Search Report and the Written Opinion of the International Searching Authority, International Application No. PCT/IB2013/055765 dated Dec. 5, 2013.

* cited by examiner

SECURITY STRUCTURE

This is a national stage application of PCT/IB2013/055765, filed internationally on Jul. 12, 2013, which claims priority to French Application No. FR 1256869, filed Jul. 16, 2012, the entire disclosures of each of which are incorporated herein by reference.

TECHNICAL FIELD

The present disclosure relates to security structures, especially those intended to be inserted into security documents.

The expression "security document" designates a means of payment, such as a banknote, a check or a meal voucher, an identity document, such as an identity card, a visa, a passport or a driving license, a lottery ticket, a travel ticket or even a ticket for entrance to a cultural or sporting event.

INTRODUCTION

In order to prevent counterfeiting or forgery and in order to increase security, it is known to use security elements applied to the surface or inserted into the bulk of or into one or more windows in a secured article, especially a security document or another object, for example a label or a piece of packaging, especially for medication, foodstuffs, cosmetics, electronic parts or spare parts.

Methods are known, such as described in documents U.S. Pat. Nos. 5,901,484 and 6,286,873, of creating the illusion of movement using a carrier bearing a plurality of coded images, corresponding, for example, to the decomposition of the movement of an object or animal, and a transparent film bearing an array of parallel lines, forming a revealing pattern, arranged on the carrier. A relative movement between the coded images and the revealing pattern allows the illusion of movement to be created.

DE 10 2006 061905 discloses a security element comprising a transparent substrate, a plurality of interleaved coded images and a revealing screen superposed on the coded images.

It is also known to superpose, by folding of a document, two optical elements. Patent application WO 2006/029744 A1 in particular describes the superposition, by folding of a document, of two optical elements allowing different optical effects to be obtained depending on the distance separating said optical elements.

Moreover, patent application WO 02/17242 A1 describes the superposition, by folding of a document, of a hologram and hidden information in order to reveal the hidden information.

Patent application JP 2009/102760 and its counterpart EP 1 903 144 seek to make invisible the verso of a colored pattern in a security paper incorporating a security thread (thread-inserted paper). This is achieved by means of a security thread comprising a metal layer arranged in registration under the colored lacquer pattern. Reflection from the metal of the incident light and its scattering in the paper allows the lacquer layer located behind to be masked. The metal layer must be opaque because otherwise the lacquer layer would be visible, which is not the targeted aim in patent application JP 2009/102760.

More and more security means thus use a revealing pattern arranged in a transparent window in order to authenticate a security document, by being superposed on an element to be revealed. This revealing pattern may be a screen, an array of points, of lines or of ordered geometric shapes or a coded image. To increase the level of security, this pattern is metalized.

The revealing pattern and the hidden information may be superposed with the revealing pattern located between the observer and the hidden information, or with the hidden information located between the observer and the revealing pattern.

Beyond a certain resolution, the revealing pattern, when it is metalized, has a high reflecting power, similar to that of a metalized planar surface. This considerably hinders authentication of the complementary element to be revealed because the user is "dazzled" by the light reflected by the metalized revealing pattern.

To decrease the amount of light reflected by the revealing pattern, it is possible to decrease the area of the elementary features forming the revealing pattern, so as to decrease the total metalized area. Since the dimensions of security structures are generally limited due to the size of the security documents for which they are intended, this amounts to decreasing the complexity and/or number of elementary features, thereby leading to a decrease in the level of security.

It is also possible, at constant metalized area, to create coarser elementary features. However, this has an impact on the revealing power of the security structure and decreases the level of security by making counterfeiting by printing easier.

Therefore there exists a need to perfect further security structures comprising one or more revealing patterns, especially taking the form of one or more screens.

SUMMARY

The subject of the present disclosure, according to an exemplary embodiment, is a security structure comprising a non-opaque carrier, such as a transparent carrier, and, borne by the carrier, metal elements forming a revealing pattern, the thickness of the metal being sufficiently small to be non-opaque, a lacquer being at least partially superposed on the metal elements and making contact with the latter.

The superposition of the lacquer and of the metal elements is an exact superposition, that is for example obtained by making the lacquer play a role in the obtention of the metal elements, according to an exemplary embodiment.

The superposition of the lacquer and of the metal elements may also not be exact, the lacquer for example taking the form of a layer that extends beyond the metal elements, even of a continuous layer that for example extends over the entire surface of one face of the security structure.

The expression "non-opaque" is understood to mean an opacity lower than about 15% according to standard ISO 2471, or more preferably lower than about 5%, according to standard ISO 2471, according to an exemplary embodiment.

The various exemplary embodiments described herein allow the gloss of the revealing pattern to be significantly decreased, by way of the lower optical density of the metal, while compensating, by virtue of the opacity provided by the lacquer and/or the carrier, for the lower opacity of the metal.

The various exemplary embodiments described herein allow the visibility of an element to be revealed associated with the revealing pattern to be improved while preserving a high security.

The lacquer may cover the metal elements on the side opposite to the carrier.

The lacquer may be interposed between the metal elements and the carrier.

The lacquer may be transparent but colored.

The lacquer may be non-transparent and preferably opaque.

The optical density of the metal of the metal elements is preferably lower than or equal to 1.5 and preferably lower than or equal to 1.0. The optical density is, for example, measured using a TBX-MC densitometer from the company TOBIAS ASSOCIATES, INC, the measurement being carried out according to standard ISO 5/2.

The lacquer may comprise a first composition covering only some of the metal elements and a second composition, different from the first, especially of different color and/or opacity to the first, covering only some of the metal elements, the first and second compositions preferably being applied without total superposition thereof and preferably without any superposition thereof. One of the compositions may be transparent. A superposition of the first and second compositions may allow a third color to appear.

At least one of the compositions may be applied so as to produce a pattern visible to the naked eye, especially in transmitted light.

The first and second compositions may be applied so as to make a preset pattern with the third color appear, this preset pattern for example also being found elsewhere on the article equipped with the security structure, this pattern for example being alphanumeric.

The security structure may be to superpose on an element to be revealed or as a variant comprises at least one element to be revealed, for example taking the form of interleaved images.

When the security structure is to be superposed on the element to be revealed, the latter for example comprises a plurality of interleaved images and a relative movement of the security structure and of the element to be revealed allows in succession the various images to appear individually.

When the security structure comprises, as manufactured, the element to be revealed, a change in the direction of observation may allow the information to be seen.

In the latter case, the revealing pattern and the element to be revealed are preferably produced on either side of a transparent carrier.

Another subject of the present disclosure, according to an exemplary embodiment, is a secured article, such as a security document, incorporating a security structure according to the various exemplary embodiments described herein.

The article may comprise information arranged to be viewable using the revealing pattern, especially information taking the form of a print.

The revealing pattern and the element to be revealed may be superposed by folding.

The security document may be folded along a median line of the document, preferably parallel to one side of the document, for example along a median line passing through the middle of the width or length of the document.

The revealing pattern and the element to be revealed may even be superposed by construction, in which case it is not necessary to fold the article.

In this case, the successive appearance of the information, for example in the form of successive images, from interleaved images, may be achieved by changing the angle of observation, as mentioned above.

Another subject of the various exemplary embodiments described herein is a process for manufacturing a security structure, comprising steps of:

depositing by printing the lacquer so as to form the design of the revealing pattern; and forming the metal pattern elements.

The metal pattern elements may be produced by demetallization, such as by chemical etching, of a metal layer covering the carrier and covered by the lacquer print, the latter protecting the pattern elements from the chemical etching. As a variant, a primer soluble in a solvent is applied to the carrier with the negative of the pattern to be produced before the metallization, then the latter is carried out. The chemical etching dissolves the primer and the metal is removed from the carrier in the locations where the soluble primer is present.

The metal layer is deposited by vacuum metallization, according to an exemplary embodiment.

According to an exemplary embodiment, the metal layer is deposited by printing.

According to an exemplary embodiment, the metal layer is a layer of copper, aluminum, a metal oxide or a mixture thereof. The metal layer is an aluminum layer, according to an exemplary embodiment.

The metal layer may comprise at least two elementary layers, especially of different compositions, such as copper, aluminum, metal oxides and their mixtures. According to this embodiment, different metallic effects are obtained depending on the face observed, providing additional security.

The lacquer may be deposited in the form of two prints of different compositions.

Another subject of the present disclosure is a method for authenticating or identifying a secured article, in which, if necessary, the revealing pattern is superposed on an element to be revealed and an indication is obtained as to the authenticity or identity of the article in light of the result of the superposition. When the revealing pattern and the element to be revealed are already superposed by construction, the method for authenticating or identifying the secured article may comprise observing the structure, and an indication is obtained as to the authenticity or identity of the article in light of the result of this observation. The observation may cause a plurality of successive images to appear, creating an animation effect, for example of movement of an animal or of a person or object. The revealing pattern may be observed in reflected and/or transmitted light and an indication obtained regarding the authenticity or identity of the article in light of the aspect observed in reflected and/or transmitted light, respectively. Specifically, since the various exemplary embodiments described herein prevent the user from being dazzled by reflected light, observation is also possible in reflected light. This especially has the effect of making it easier to authenticate or identify the security element.

The revealing pattern may also be observed in transmitted light independently of its superposition on the element to be revealed and an indication regarding the authenticity or identity of the article may be deduced therefrom in light of the aspect observed in transmitted light, such as when two lacquer compositions are used as mentioned above, or when the lacquer is deposited with a preset pattern that does not exactly superpose on the metal elements.

Lacquer

The term "lacquer" must be understood to mean a non-metal coating. The lacquer may be a composition containing a volatile solvent that forms a film when it dries or a lacquer that crosslinks under the action of an energy beam, such as a UV beam, or heat. For example, the lacquer is an aqueous lacquer.

The lacquer increases the opacity of the structure, at least for some of the revealing pattern.

The lacquer is preferably colored, for example containing one or more pigments or dyes.

The lacquer may define the exterior surface of the revealing pattern.

As a variant, the lacquer is located between the metal layer and the carrier. Observation may be carried out from the side on which the metal is visible to the observer, i.e. through the carrier or not, depending on the circumstances.

The lacquer may be applied by rotogravure, flexographic or screen printing.

The lacquer may serve to protect the metal elements during their manufacture by chemical etching of a metal layer covered by the lacquer. In this case, the lacquer and the metal may be exactly superposed in the security structure. According to an exemplary embodiment, the superposition is not exact.

Carrier

Carrier designates any monolayer or multilayer, monomaterial or multimaterial substrate and especially a substrate taking the form of a thermoplastic film.

The carrier may comprise or consist of a thermoplastic, for example a polyolefin, for example polyethylene (PE), polyvinyl chloride (PVC), polyester, polyethylene terephthalate (PET), polycarbonate (PC), polyester carbonate (PEC), polyethylene glycol terephthalate (PETG), acrylonitrile butadiene styrene (ABS) or a light-collecting film, a "waveguide" for example, such as the polycarbonate-based light-emitting film sold by BAYER under the trademark LISA®.

The carrier is made of polyester or PET, according to an exemplary embodiment.

The thickness of the carrier is, for example, between about 10 μm and about 1 mm, or more preferably between about 6 μm and about 1 mm, or between about 6 μm and about 300 μm, or between about 10 μm and about 100 μm, or between 12 about μm and 40 about μm, according to an exemplary embodiment.

The carrier may be transparent, according to an exemplary embodiment.

According to an exemplary embodiment, the carrier is translucent and colored so as to at least partially compensate for the small thickness of metal.

Information

The revealing pattern according to the various exemplary embodiments described herein allows information to be revealed by being used conjointly with an element to be revealed.

The element to be revealed may take the form of a combined image comprising a plurality of interleaved coded images. In this case, the revealing pattern is advantageously a revealing screen. The revealing screen, when superposed on the combined image, then allows the coded images to be observed during a change of the observation direction and/or during a relative movement between the revealing pattern and the element to be revealed, via a parallax effect.

The combined image may comprise at least two interleaved coded images. According to an exemplary embodiment, combined image comprises at least three interleaved coded images and, more preferably, four interleaved coded images.

The revealing pattern and the element to be revealed may be configured in order to allow an "animation effect" to be observed. In the context of the present disclosure, the term "animation" is to be understood as having a broad meaning. It may be a question of a plurality of images of a given object, representing different viewing angles, in order to create a 3D or relief effect, rather than the effect of movement.

The combined image may correspond to the decomposition of the movement of a pattern, for example of a text, alphanumeric symbols, ideograms, an object, a person and/or an animal.

The information may even be hidden within the element to be revealed and appear by simple superposition of the revealing pattern and the element to be revealed or inclination of the superposition of the revealing pattern and the element to be revealed.

The information may even be an image resulting from a spatial interference effect between two superposed arrays, one corresponding to the revealing pattern and the other to the element to be revealed. Such a moiré effect may result from the orientation of the superposed arrays being shifted by a specific nonzero angle and may disappear when the arrays are exactly superposed or are offset by an angle different from the specific angle. The screen is preferably a preset and constant distance from the element to be revealed, at least during the observation.

The information may appear by changing the angle of observation, the revealing pattern and the element to be revealed being superposed by construction.

According to an exemplary embodiment, in order to make the information appear, the revealing pattern and the element to be revealed may be superposed by folding the secured article over itself.

When the element to be revealed and the revealing pattern are superposed by construction, the element to be revealed and the revealing pattern are located on either side of the carrier, which may be at least partially transparent and entirely transparent.

Revealing Pattern

The revealing pattern is matched to the element to be revealed with which it must be superposed, according to an exemplary embodiment.

The revealing pattern may comprise no information directly comprehensible by the observer, such as no text or image present elsewhere on the article.

The revealing pattern may have an outline of any shape, for example circular, oval, star-shaped or polygonal, for example rectangular, square, hexagonal, pentagonal or rhombus-shaped, inter-alia.

A revealing pattern and an element to be revealed may be arranged adjacently, as illustrated, for example, in FIGS. 14 and 15 of WO 2010/073225. For example, a plurality of peripheral combined images each comprising a plurality of interleaved images may be arranged around a central revealing screen upon an article or a region of an article with a view to superposition on a complementary arrangement with a revealing pattern that extends around a central element to be revealed, present on another article or another region of the article. During use, the central revealing screen is superposed on the central element to be revealed and the peripheral combined images are superposed on the revealing pattern of the complementary arrangement. According to an exemplary embodiment, the superposition is achieved by construction, on either side of a given carrier.

Generally, the outline of the revealing screen may represent a text, an alphanumeric symbol, an ideogram, an object, a person and/or an animal, optionally present elsewhere on the document.

The revealing pattern is formed by a plurality of elementary features, which may be identical.

The elementary features may be arranged with a regular spacing.

The elementary features may be lines or points or other motifs, such as arranged in an array.

In one embodiment, the elementary features are lines arranged so as to form a revealing screen.

The period of the revealing screen may be, for example, smaller than or equal to the thickness of the carrier, or more preferably smaller than or equal to about 1 mm According to an exemplary embodiment, period of the revealing screen is, for example, between about 10 μm and about 800 μm and more preferably between about 30 μm and about 300 μm.

The lines of the screen formed by the metal elements may be wider than the interval existing between two such lines.

The revealing screen may comprise opacifying lines with optionally non-rectilinear parallel edges. Opacifying lines with non-rectilinear edges may be more difficult for a counterfeiter to reproduce.

The elementary features forming the revealing pattern comprise a metal layer, according to an exemplary embodiment. The latter has an optical density that is relatively low and may be lower than or equal to about 0.8. The optical density D corresponds to the inverse logarithm of the transmittance:

$D=-\log(T)$. The transmittance T is the amount of light that passes through the layer or layers analyzed. It may be measured using the aforementioned TBX-MC densitometer.

To measure the optical density of the metal layer of the revealing pattern a transparent carrier coated continuously with a given thickness of metal is used, such as the carrier before the demetallization that forms the revealing pattern.

The optical density depends on the thickness of metal deposited. The smaller the thickness, the lower the optical density. By way of example, optical densities of 0.6, 2, 2.5 and 3.6 correspond to the following thicknesses of aluminum: 20, 190, 300 and 400 Å, respectively.

The period of the revealing screen, which can be smaller than about 200 μm, may prevent reproduction by photocopying and also ensure protection against the use of scanners. The period of the revealing screen designates the cumulative width of an opacifying line and of an interline in the case of a screen formed from an array of parallel lines.

The resolution of the revealing pattern may be directly related to the thickness of the carrier. The resolving power of the human eye designates the ability of the human eye to separate a detail on the element to be revealed; it is about 1 minute of arc, which represents 90 μm at a distance of observation of 30 cm. The resolution of the revealing pattern may be higher than or equal to about 800 dpi, or more preferably higher than about 2000 dpi, or more preferably higher than about 3000 dpi. According to an exemplary embodiment, the interline is smaller than the resolving power of the eye. Surprisingly, the coded image is visible through the screen despite the fact that the interline is smaller than the resolving power of the eye, the advantage being that in this case the screen is invisible at a distance of observation, for example, of 30 cm.

The revealing pattern may be, as such, uniform in aspect to the naked eye, on account of its fineness. For example, the revealing pattern may appear to the naked eye as having a uniform aspect and a uniform color.

The fact that the revealing pattern is uniform in aspect to the naked eye may make the security article according to the various exemplary embodiments described herein pleasant and interesting to the general public.

The gloss of the revealing pattern may have a gloss value between about 100 and about 400. The gloss is measured in gloss units GU at 20° according to the 3rd part of standard ISO 8254.

Security Structure

The security structure may consist of a sticker and/or a foil.

The security structure may or may not extend from one edge to the other of the article, for example, in the form of a security thread.

The security structure may or may not be incorporated into one or more windows in the article.

The security structure may be completely or partially covered with a material that is invisible under "normal" illumination, e.g., when illuminated by daylight or an artificial light source. This material that is invisible under normal illumination is for example a material that is visible under a specific illumination, such as a luminescent material, for example a fluorescent or phosphorescent material visible under UV or IR illumination. According to an exemplary embodiment, the material may comprise, on a reflective background, nematic liquid crystals that are visible with a polarizing filter, such as a circular polarizing filter.

Completely or partially covering the security structure with such a material, i.e. a material that is invisible under "normal" illumination, may form an additional security feature taking the form of a pattern, for example, a word, acronym, code, symbol, image, ideogram or alphanumeric character.

The security structure may be incorporated into the article by adhesive bonding or by incorporation into a fibrous substrate of the article during its manufacture, according to an exemplary embodiment.

The metal and/or the lacquer may be magnetic. Thus, depending on the circumstances, a different magnetic response is obtained. It may be advantageous, in the case of a revealing screen, to have different periods, because this allows different magnetic responses to be obtained.

The security structure may or may not comprise, by construction, the element to be revealed.

When the security structure does not comprise the element to be revealed, the security structure may be superposed on the element to be revealed during the identification or authentication.

When the security structure comprises the element to be revealed, the identification or authentication may be carried out by observing in a number of directions of observation, for example.

The revealing pattern and the element to be revealed may be produced on either side of the carrier, and the latter may be transparent.

Other Security Elements

The article, or the security structure that it contains, may comprise one or more additional security elements such as defined below.

Among additional security elements, certain are detectable by eye, under daylight or artificial light, without any particular apparatus being required. These security elements, for example, comprise colored fibers or flakes, or partially or completely metalized or printed threads. These security elements are called first-level security elements.

Other types of additional security elements are detectable only using a relatively simple apparatus, such as a lamp emitting in the ultraviolet (UV) or infrared (IR). These security elements for example comprise fibers, flakes, strips, threads or particles. These security elements may or may not be visible to the naked eye, such as via illumination under a Wood's lamp emitting light at a wavelength of 365 nm. These security elements are called second-level security elements.

Other types of additional security elements require a more sophisticated detection apparatus to detect them. These security elements are, for example, capable of generating a specific signal when they are subjected, simultaneously or not, to one or more sources of exterior excitation. The automatic detection of the signal allows, if required, the document to be authenticated. These security elements, for example, comprise tracers taking the form of active materials, particles or fibers, capable of generating a specific signal when these tracers are subjected to an optronic, electric, magnetic or electromagnetic excitation. These security elements are called third-level security elements.

The one or more additional security elements present within the article, or the security structure that it contains, may have first-, second-, or third-level security features.

Another subject of the present disclosure, according to another of its aspects, is a security structure comprising:

a non-opaque carrier;

a pattern formed from elementary metal pattern elements; and first and second lacquer compositions superposed on the metal pattern elements, especially exactly, and having different opacities, the elementary pattern elements being non-opaque and the first and second compositions being deposited so as to create a pattern in transmitted light by virtue of the contrast generated by the opacity difference of the compositions.

This security structure may have any one of the features of the security structure defined above and especially be associated, whether by construction or not, with an element to be revealed, the pattern formed of metal pattern elements then serving as the revealing pattern.

BRIEF DESCRIPTION OF THE DRAWINGS

The various exemplary embodiments described herein will be better understood on reading the following detailed description of nonlimiting embodiments thereof and on examining the appended drawings, in which.

DETAILED DESCRIPTION

Figure 1:
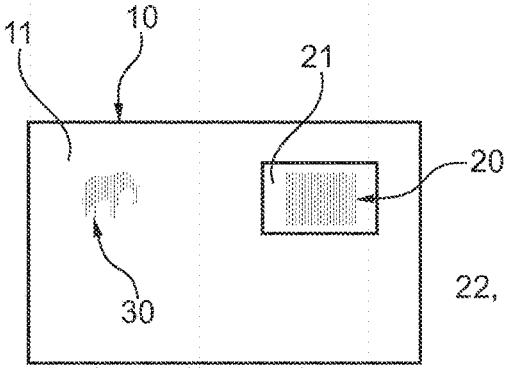
FIG. 1 shows a security document comprising a security structure, according to an exemplary embodiment, and an element to be revealed, associated with the security structure.

FIG. 1 shows an example security document 10 such as a banknote. The following applies to other articles.

This document 10 comprises a substrate 11, for example made of paper, that incorporates a security structure 20, according to an exemplary embodiment.

The document 10 also comprises an element to be revealed 30, for example comprising at least one coded image made visible by virtue of the security structure 20 when the latter is superposed on the element to be revealed 30.

The document 10 may be authenticated by folding the document so as to at least partially superpose the element to be revealed 30 and the revealing pattern 20 and then moving them relative to each other so as to, for example, view the illusion of a movement and/or to modify the angle of observation of the superposed element to be revealed and revealing pattern. According to an exemplary embodiment, the element to be revealed and the revealing means are superposed so as to make contact.

The observation may be carried out in reflected light, the observer viewing the combined image and the revealing screen in reflection under illumination from a light source.

According to an exemplary embodiment, it may also be possible to superpose at least partially the document 10 with another similar document.

Figure 4:
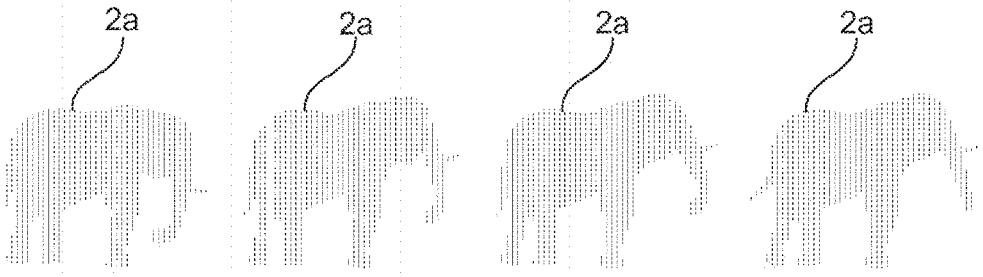
FIG. 4 shows the coded images of the combined image corresponding to the element to be revealed in FIG. 2, according to an exemplary embodiment.

FIG. 4 shows a series 2*a* of the interleaved images $I_i, \ldots I_j$, where j is for example equal to four, allowing a combined image 2 of the element to be revealed 30 to be created representing, in this example, a pattern taking the form of an elephant.

The interleaved images $I_i, \ldots I_j$, for example correspond to four different positions of the elephant and thus allow a decomposition of the movement of the elephant to be created. Each interleaved image 2*a* comprises a set of parallel lines.

Figure 2:
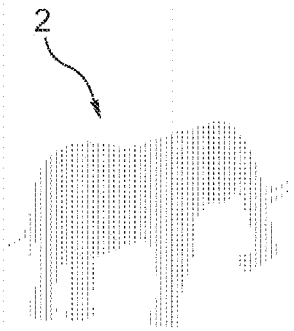
FIG. 2 shows in isolation the element to be revealed, according to an exemplary embodiment.

FIG. 2 shows the combined image obtained from the series of interleaved images 2*a* in FIG. 4, as it figures on the element to be revealed 30.

All the constituent elements of a given coded image may be arranged with the same period p as the opacifying lines of the revealing screen, along the axis X of movement, perpendicular to the lines.

The images 2*a* are superposed on one another so as to form a combined pattern that corresponds to the combined image.

Figure 3:
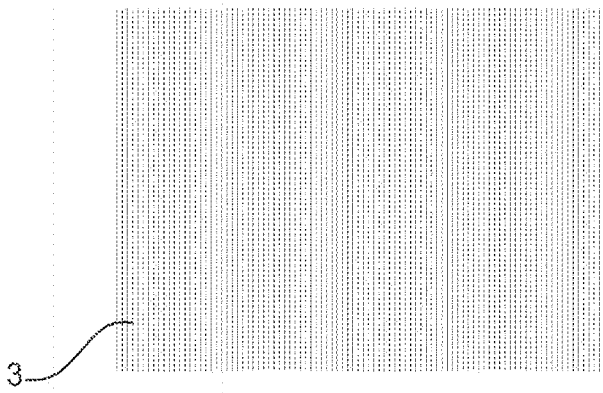
FIG. 3 schematically shows in isolation the revealing pattern, according to an exemplary embodiment.

FIG. 3 shows the revealing pattern 20 taking the form of a revealing screen associated with the combined image in FIG. 2.

Figure 3A:
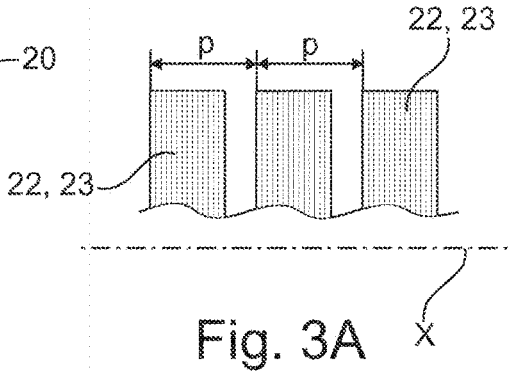
FIG. 3A shows a detail of FIG. 3.

The revealing pattern 20 is, for example, composed of a periodic elementary feature, in the present case an opacifying line, of constant period p, as illustrated in FIG. 3A.

The revealing pattern 20 is, for example, rectangular in shape.

The revealing pattern 20 has an area, a length and a width that may be larger than those of the combined image, thus allowing all of the movements of the elephant to be viewed more easily during the relative movement of the element to be revealed 30 and the revealing pattern 20, such as via a relative translational movement or change of angle of observation.

Figure 5:
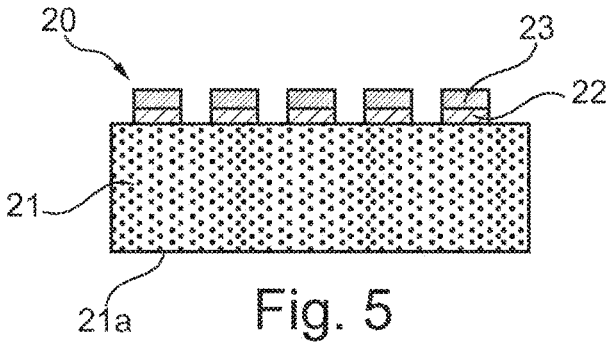
FIG. 5 schematically and partially shows in cross section the security structure bearing the revealing pattern in FIG. 3, according to an exemplary embodiment.

FIG. 5 shows the security structure 20. The latter comprises a carrier 21, for example, made of transparent PET, covered on one face by a metalized layer 22, itself covered with a lacquer 23. The metalized layer 22 is of low optical density. The lacquer 23 is, for example, black in color.

The metal is preferably aluminum. Preferably, the observation is carried out from the verso, i.e. from the lower face 21*a* in FIG. 5, so as to protect the features and observe the metallic appearance. Depending on the way in which the incorporation into the substrate is carried out, the recto may be observable, the metallic/nonmetallic difference in aspect of the recto/verso providing an additional security feature.

The lacquer 23 on the metalized layer increases the opacity, so as to allow the element to be revealed 30 to be authenticated.

To produce the security structure 20, the carrier 21 may be uniformly metalized, according to an exemplary embodiment. Next, the lacquer 23 is deposited, for example by printing, with the revealing pattern to be produced. The metal zones not protected by the lacquer 23 are removed.

Figure 9:
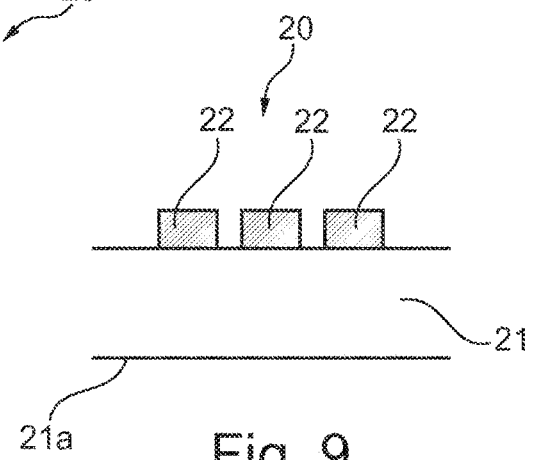
FIG. 9 is an analogous view to FIG. 6 of an exemplary embodiment of the security structure.

By way of example, FIG. 9 shows a security structure in which the carrier 21 has been metalized and then selectively demetalized by chemical action.

Although it is preferable to produce the revealing pattern by depositing the lacquer on the metalized carrier, the revealing pattern may be produced by metalizing a carrier on which a primer has been deposited with the negative of the pattern to be produced, according to an exemplary embodiment.

The metal may be selectively removed by chemical action using a solvent that dissolves the primer, according to an exemplary embodiment. By way of example of processes allowing metal elements to be produced with the desired pattern, mention may be made of WO 99/13157, EP 1 291 463 and WO 02/31214, among other documents. Reference may also be made to the prior art cited in these documents.

Comparative Trials

The table below gives gloss measurements at an incidence of 20° for unapertured metalized films and then after production of the screens. The optical density is measured before demetallization.

The values of 158, 200 or 400 μm correspond to the period of the screen.

| | Metalized film | | Partially demetalized film: 158 μm screen | | Partially demetalized film: 200 μm screen | | Partially demetalized film: 400 μm screen | |
|---|---|---|---|---|---|---|---|---|
| | Low OD (0.7) | High OD (2.2) | Low OD | High OD | Low OD | High OD | Low OD | High OD |
| Lacquer | No | No | Colored | Colored | Colored | Colored | Colored | Colored |
| Gloss at 20° | 210 | 361 | 175 | 365 | 165 | 246 | 133 | 198 |

The gloss was measured according to the 3rd part of standard ISO 8254, such as at 20°.

The metalized film was a polyester film covered with an aluminum layer, of different thicknesses corresponding to the optical densities. The metal films of low and high optical densities correspond for example to metal thicknesses of about 50 Å and about 300 Å, respectively.

The measurements confirm the lower gloss of low optical density films relative to high optical density films. When a screen is present, the tendency is the same.

To evaluate how effective a colored lacquer was at opacifying the screen, measurements were carried out on high and low optical density metalized films before and after printing of the lacquer. The results are given in the table below:

| Opacity (white background) | Metalized film | | Non-demetalized film: printed 158 μm screen | | Non-demetalized film: printed 200 μm screen | | Non-demetalized film: printed 400 μm screen | |
|---|---|---|---|---|---|---|---|---|
| | Low OD | High OD | Low OD | High OD | Low OD | High OD | Low OD | High OD |
| | 24 | 85 | 76 | 95 | 77 | 93 | 69 | 89 |

The opacity on white background was measured according to standard ISO 2471.

Application of the colored lacquer allowed the low optical density film to be considerably opacified. The opacity obtained is then close to that of the high optical density film before printing.

Images having a plurality of tones may be produced on the revealing pattern using lacquers of different opacities on the elementary features.

Figure 6:
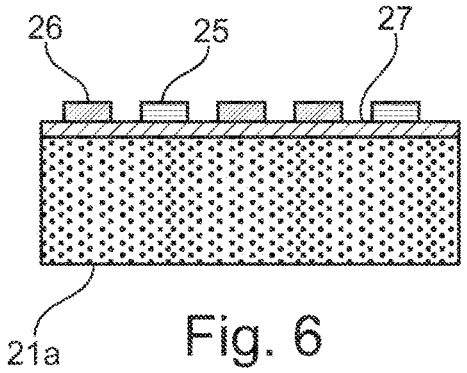
FIG. 6 shows the structure in FIG. 7, before demetallization, according to an exemplary embodiment.
Figure 7:
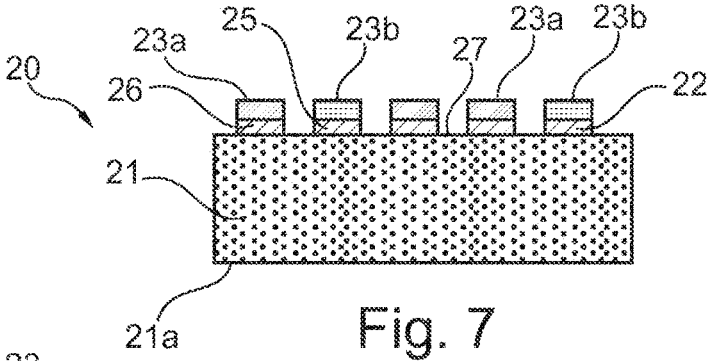
FIG. 7 is an analogous view to FIG. 5 of the security structure, according to an exemplary embodiment.

For this purpose, referring to FIGS. 6 and 7, a transparent protective lacquer 23*a* may be applied to zones 26 of the metalized film 22, and a colored protective lacquer 23*b* to zones 25, the intermediate zones 27 being unprotected, as illustrated in FIG. 6, before demetallization.

After demetallization, as illustrated in FIG. 7, the zones 27 are transparent, the zones 26 semi-opaque and the zones 25 a little more opaque. In transmitted light, a pattern appears, related to the contrast between the zones 25 and 26, which pattern was less visible in reflected light or even not visible in reflected light.

Incorporation into One or More Windows

Advantageously, the security structure figures in at least one window of the secured article, such as of the security document, such as in the case in the example in FIG. 1.

The window may be formed by a lack of material, for example a local absence of paper, above or below the security structure, the window being at least partially transparent or translucent on the side of the security structure opposite the lack of material. Thus, it may be possible to observe a first side of the security structure on the side of the lack of material and a second side of the security structure, opposite the first, on the side of the transparent or translucent zone of the window.

The window may even not comprise a lack of material. The window may, for example, be at least partially transparent or translucent on either side of the security structure, the transparent or translucent zones being superposed on each other in order to allow the two opposite sides of the security structure to be observed.

The window may even be a through-window. The window may be present due to a lack of material superposed on either side of the security structure. The two sides of the security structure may thus be observable directly and not through transparent or translucent zones. The security structure may be completely or partially incorporated in the window.

The article may comprise a plurality of windows, such as described in the exemplary embodiments herein.

Examples of production of windows in security documents are, for example, described in GB 1 552 853, which discloses the creation of a window especially by transparentisation, laser cutting, abrasion or mechanical incision; in EP 0 229 645, which describes the creation, using masks, of a window in one face or in both faces of a two-ply paper; in WO 2004/096482, which describes the creation of a window by laser cutting; in CA 2 471 379, which describes the creation of a transparent window and association with a security element; and in WO 2008/006983, which describes the creation of a transparent window in a two-ply paper.

Figure 10:
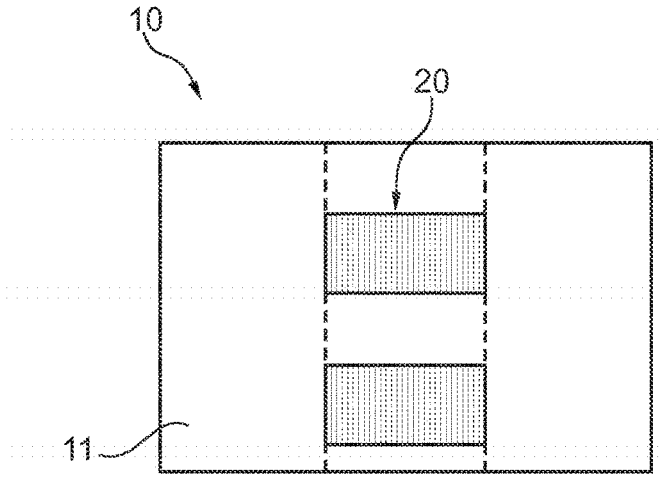
FIG. 10 shows an example article incorporating a security structure produced, according to an exemplary embodiment.

FIG. 10 shows an incorporation into windows in a fibrous substrate when the security structure 20 takes the form of a security thread that extends from one edge to the other of the document, according to an exemplary embodiment. The revealing pattern, for example, appears in zones of the document in which the thread is flush with the surface of the fibrous substrate.

The document may comprise a plurality of such zones.

In the case of an incorporation into windows of a security structure taking the form of a security thread, said structure may incorporate by construction the element to be revealed, and, for example, have the arrangement shown in FIG. 11, which is described below.

Production of the Element to be Revealed

The element to be revealed may be added to the secured article by a printing process, for example offset printing, gravure printing, laser printing, rotogravure printing or screen printing. For example, the element to be revealed is printed with optionally metallic, optionally magnetic inks that are optionally colored, visible to the naked eye, under ultraviolet (UV) and/or infrared (IR) light, opaque or luminescent, especially fluorescent, thermochromic or photochromic or that produce an interference effect, especially an iridescence, or an optical effect that varies depending on the angle of observation (gonochromatic) and especially inks comprising liquid crystals, inter alia. When a magnetic ink is used, the pattern may form a magnetic signature allowing additional authentication of the substrate via detection of said signature. The element to be revealed 30 may also comprise metallizations and/or demetallizations, for example made of aluminum.

When the element to be revealed is at least partially produced with at least one thermochromic and/or photochromic ink, only some of the element to be revealed is for example to be observable under preset illumination and/or temperature conditions.

The element to be revealed may even be printed with liquid crystals, such that for example the coded images are visible only through a polarizer. These may in particular be nematic liquid crystals.

The element to be revealed may be a watermark or a pseudo-watermark.

The revealing pattern and/or the element to be revealed may be monochromatic or polychromatic.

The element to be revealed and/or the revealing pattern may be produced with different colors.

The use of color to produce the element to be revealed may allow the security of the article to be further increased.

Figure 11:
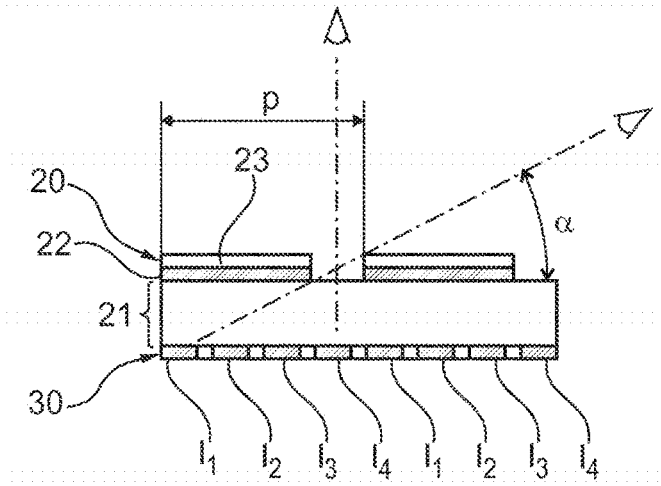
FIG. 11 is a schematic cross-sectional view of another security structure, according to an exemplary embodiment, in which the element to be revealed and the revealing pattern are superposed by construction.

The element to be revealed may be incorporated by construction in the security structure, for example by being produced on that face of the carrier 21 which is opposite the face bearing the revealing pattern, as illustrated in the exemplary embodiment of FIG. 11.

When the angle of observation a varies, the user may see appear in succession the various interleaved images, which, in the example of the present case, are four in number $I_1, \ldots I_4$.

Exemplary Revealing Patterns

The security structure may comprise two revealing patterns, according to an exemplary embodiment, for example, taking the form of screens, associated with two elements to be revealed, respectively, the orientation of the lines of one of the revealing screens being different from those of the other revealing screen. When the lines are not rectilinear, their orientation is defined by the general direction in which they extend.

The security structure may comprise two revealing screens, whether juxtaposed or not or superposed or not, comprising lines which may or may not have the same orientation. One of the revealing screens may be completely or partially encircled by the other revealing screen. An optional zone of superposition of the revealing screens may cause a sort of grid pattern to appear if the strips of the revealing screens have different orientations.

Figure 8:
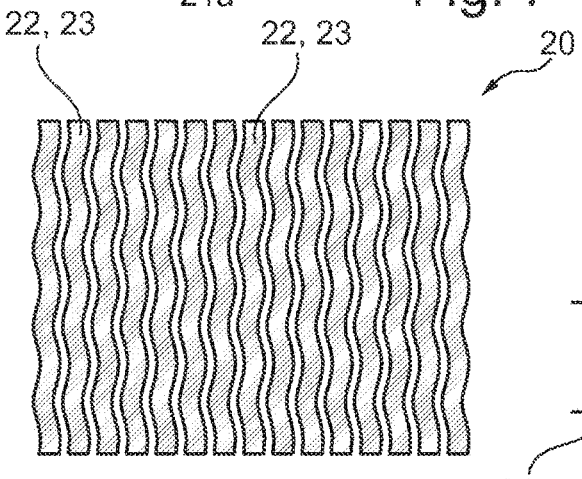
FIG. 8 shows a variant revealing pattern, according to an exemplary embodiment.

The revealing screen may comprise other features than strips of constant width having rectilinear parallel edges, such as, for example, crenellations or undulations, such as illustrated in the exemplary embodiment of FIG. 8.

According to an exemplary embodiment, two combined images of different sizes are associated. The smaller combined image may be repeated, such as to form an array, which may be in rows and columns, in order to appear as a background on which the larger combined image is arranged. The associated revealing pattern then includes of a first revealing pattern matched to the larger combined image, and of a second revealing pattern matched to the smaller combined image.

The two different combined images may have similarities and/or complement each other. They may in particular be identical and/or symmetric.

Figure 12:
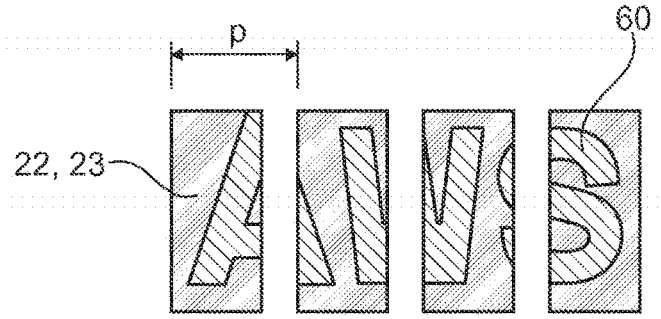
FIG. 12 shows a revealing pattern equipped with an additional security element, according to an exemplary embodiment.

A coating that is visible under preset illumination conditions, such as a luminescent coating, a fluorescent coating, for example, may be deposited on the metal elements and/or the lacquer. For example, FIG. 12 shows a print 60 of a UV ink describing an "AWS" pattern that is observable only when under UV illuminant.

The security structure according to the various exemplary embodiments described herein may be incorporated into a security document, such as a banknote, or into other security documents such as a card, such as a multilayer card, a page containing personal data, or a film for protecting personal data.

The carrier is, for example, a thread or a foil or a sticker. The carrier may be a transparent film that may, for example, extend over the entire length and width of the document.

The expression "comprising a" must be understood as being synonymous with "comprising at least one", unless otherwise specified.

The invention claimed is:

1. A security structure, comprising:

a non-opaque carrier;

metal elements borne by the carrier and forming a revealing pattern, a thickness of each of the metal elements being sufficiently small so that the metal elements are not opaque;

a lacquer at least partially superposed on the metal elements, the lacquer making contact with the metal elements; and an element to be revealed superposed on the revealing pattern, the element to be revealed being incorporated by construction in the security structure and comprising a plurality of interleaved images, the revealing pattern allowing the plurality of interleaved images to appear in succession when a direction of observation changes.

2. The structure as claimed in claim 1, the lacquer comprising a first composition covering a first zone of the metal elements and a second composition, different from the first composition, covering a second zone of the metal elements.

3. The structure as claimed in claim 2, one of the first and second compositions being transparent.

4. The structure as claimed in claim 2, at least one of the first and second compositions being applied so as to produce a pattern visible to a naked eye in transmitted light.

5. The structure as claimed in claim 1, the element to be revealed and the revealing pattern being arranged on either side of the carrier.

6. A secured article comprising a security structure as defined in claim 1.

7. The article as claimed in claim 6, comprising information viewable using the revealing pattern.

8. The article as claimed in claim 6, the security structure being incorporated in windows of the article.

9. A method for manufacturing a security structure according to claim 1, comprising:

depositing, by printing, the lacquer so as to form a design of the revealing pattern; and forming patterned metal elements.

10. The method as claimed in claim 9, the patterned metal elements being produced by etching a metal layer covering the carrier and covered by the lacquer.

11. The method as claimed in claim 9, the lacquer being deposited in a form of two prints of different compositions.

12. A method for authenticating or identifying a secured article as defined in claim 7, further comprising authenticating or identifying the secured article based on an optical effect obtained in response to superposition of the revealing pattern on the information.

13. The structure as claimed in claim 1, wherein the carrier is transparent.

14. The structure as claimed in claim 1, wherein the lacquer is exactly superposed on the metal elements.

15. The structure as claimed in claim 1, wherein the lacquer makes contact with the metal elements.

16. The structure of claim 2, wherein the second composition is of different color and opacity than the first composition.

17. The structure of claim 2, wherein the first and second compositions do not overlap.

18. The structure as claimed in claim 1, the element to be revealed being produced by printing.

19. A security structure, comprising:

a non-opaque carrier;

metal elements borne by the carrier and forming a revealing pattern, a thickness of each of the metal elements being sufficiently small so that the metal elements are not opaque;

a lacquer at least partially superposed on the metal elements, the lacquer covering the metal elements on a side opposite to the carrier; and an element to be revealed superposed on the revealing pattern, the element to be revealed being incorporated by construction in the security structure and comprising a plurality of interleaved images, the revealing pattern allowing the plurality of interleaved images to appear in succession when a direction of observation changes.

20. The structure as claimed in claim 19, the lacquer being non-transparent.

21. The structure as claimed in claim 19, the element to be revealed being produced by printing.

22. A security structure, comprising:

a non-opaque carrier;

metal elements borne by the carrier and forming a revealing pattern, a thickness of each of the metal element being sufficiently small so that the metal elements are not opaque;

a lacquer at least partially superposed on the metal elements, the lacquer making contact with the metal elements, the lacquer being interposed between the metal elements and the carrier in a direction perpendicular to a main plane of the security structure; and an element to be revealed superposed on the revealing pattern, the element to be revealed comprising a plurality of interleaved images, the revealing pattern allowing the plurality of interleaved images to appear in succession when a direction of observation changes.

23. The structure as claimed in claim 22, the lacquer being transparent but colored.

24. The structure as claimed in claim 20, wherein the lacquer is opaque.

25. A secured article comprising an element to be revealed and a security structure to superpose on the element to be revealed, the security structure comprising:

a non-opaque carrier;

metal elements borne by the carrier and forming a revealing pattern, a thickness of each of the metal elements being sufficiently small so that the metal elements are not opaque; and a lacquer at least partially superposed on the metal elements, wherein the element to be revealed comprises a plurality of interleaved images, the revealing pattern allowing the interleaved images to appear individually in succession upon a relative movement between the revealing pattern and the element to be revealed, and wherein the element to be revealed being added to the secured article by a printing process.

* * * * *